US010132154B2

(12) United States Patent
Witte et al.

(10) Patent No.: US 10,132,154 B2
(45) Date of Patent: Nov. 20, 2018

(54) CONTROL SYSTEM AND METHODS FOR MOVING A COILED TUBING STRING

(71) Applicant: PREMIER COIL SOLUTIONS, INC., Waller, TX (US)

(72) Inventors: M. Brett Witte, Waller, TX (US); Randall Dean Behrens, Sealy, TX (US); Shaun Kallis, Waller, TX (US); Javier Sauceda, Waller, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 0 days.

(21) Appl. No.: 15/964,937

(22) Filed: Apr. 27, 2018

(65) Prior Publication Data

US 2018/0266234 A1 Sep. 20, 2018

Related U.S. Application Data

(63) Continuation-in-part of application No. 15/660,057, filed on Jul. 26, 2017.

(60) Provisional application No. 62/366,802, filed on Jul. 26, 2016.

(51) Int. Cl.

| | |
|---|---|
| ***E21B 19/22*** | (2006.01) |
| ***E21B 44/02*** | (2006.01) |
| ***E21B 4/02*** | (2006.01) |
| ***E21B 19/08*** | (2006.01) |

(52) U.S. Cl.

CPC ..... *E21B 44/02* (2013.01); *E21B 4/02* (2013.01); *E21B 19/08* (2013.01); *E21B 19/22* (2013.01)

(58) Field of Classification Search

None

See application file for complete search history.

(56) References Cited

U.S. PATENT DOCUMENTS

| | | | |
|---|---|---|---|
| 3,313,346 | A | 4/1967 | Cross |
| 3,765,489 | A | 10/1973 | Maly |
| 4,585,061 | A | 4/1986 | Lyons, Jr. et al. |
| 5,133,405 | A | 7/1992 | Elliston |
| 5,419,405 | A | 5/1995 | Patton |
| 5,765,643 | A | 6/1998 | Shaaban et al. |
| 6,276,454 | B1 | 8/2001 | Fontana et al. |

(Continued)

OTHER PUBLICATIONS

Int'l Search Report & Written Opinion (PCT/US/2017/043925), dated Oct. 5, 2017.

*Primary Examiner* — Shane Bomar

(74) *Attorney, Agent, or Firm* — Lloyd L. Davis; Hunton Andrews Kurth LLP

(57) ABSTRACT

A method of controlling rates of moving a coiled tubing string in a wellbore includes providing an injector head control system for moving a bottom hole assembly at an end of the coiled tubing string in the wellbore, that maintains operating settings of the injector head if the control system determines that the bottom hole assembly is moving in the wellbore within a range of rates, and varies operating settings of the injector head if the control system determines that the bottom hole assembly is moving in the wellbore outside the range of rates, to thereby revert to moving the bottom hole assembly in the wellbore within the range of rates. The control system determines whether the bottom hole assembly is moving within or outside the range of rates based on one or more sources of feedback from both the bottom hole assembly and the injector head.

8 Claims, 5 Drawing Sheets

(56) References Cited

U.S. PATENT DOCUMENTS

| | | | | |
|---|---|---|---|---|
| 2003/0034162 | A1 | 2/2003 | Kulhanek | |
| 2003/0201099 | A1 | 10/2003 | Steffenhagen et al. | |
| 2004/0020658 | A1 | 2/2004 | Kulhanek et al. | |
| 2004/0040707 | A1* | 3/2004 | Dusterhoft | E21B 17/206 166/279 |
| 2004/0182574 | A1* | 9/2004 | Adnan | E21B 44/00 166/250.01 |
| 2009/0235656 | A1 | 9/2009 | Havinga | |
| 2013/0213641 | A1* | 8/2013 | Layden | E21B 29/06 166/250.01 |
| 2016/0090832 | A1 | 3/2016 | Mock | |
| 2017/0260817 | A1 | 9/2017 | Dobkins et al. | |

* cited by examiner

--PRIOR ART--

CB = Counterbalance Valve(s)
DV = Diverter Valve
EPFC = Electro-Proportional Flow Control
PLC = Programmable Logic Controller CB = Counterbalance Valve(s)
DV = Diverter Valve
EPFC = Electro-Proportional Flow Control
PLC = Programmable Logic Controller

CONTROL SYSTEM AND METHODS FOR MOVING A COILED TUBING STRING

CROSS-REFERENCE TO RELATED APPLICATIONS

This application claims benefit under 35 U.S.C. § 120 as a continuation-in-part to U.S. application Ser. No. 15/660,057 filed on Jul. 26, 2017, which claims priority under 35 U.S.C. § 119(e) to U.S. Provisional Application No. 62/366,802, filed on Jul. 26, 2016, the entireties of which are incorporated herein by reference.

FIELD

Embodiments disclosed herein relate to a control system for coiled tubing unit injector heads. More specifically, embodiments disclosed herein relate to a control system and methods for moving a coiled tubing string in a wellbore within a range of rates.

BACKGROUND

In the oil and gas industries, coiled tubing refers to a very long metal pipe supplied spooled on a large reel. It is used for interventions in oil and gas wells and sometimes as production tubing in depleted gas wells. A relatively modern drilling technique involves using coiled tubing instead of conventional drill pipe. Instead of rotating the drill bit by using a rotary table or top drive at the surface, it is turned by a downhole mud motor, powered by drilling fluid pumped from the surface.

FIG. 1 illustrates generally a coiled tubing setup 5. Coiled tubing 7 is fed from a reel 8 into a coiled tubing injector 10 which effectively powers the tubing into a wellhead 12. The end of the coiled tubing string 7 can be outfitted with numerous downhole tools including drill bits and other related drilling equipment. The "gooseneck" 9 is the angled piece above the coiled tubing injector 10 which guides the coiled tubing string 7 and allows a bending of the coiled tubing string 7 to allow it to enter and pass through the injector 10. It is what guides the coiled tubing string 7 from the reel 8 and directs the tubing from an upwards angle and turns it to a vertically downward extending direction into the injector 10 and through a blow-out preventer (BOP) stack into the wellhead 12. The injector 10 and gooseneck 9 are connected together and are suspended by a crane or similar lifting methods for coiled tubing operations.

Oil and gas well drilling is typically performed using precise computerized methods to adjust instantaneously to any changes, faster than a human can process. Total human control in the past has led to damage to drill bits or the casing, and the weight of the coiled tubing string above it can force the coiled string into a "runaway" or uncontrolled descent. For example, too high of a drill rate does not allow for proper degradation of larger pieces of plugs or other materials, which then clog the pathway and restrict movement, and can damage an entire coiled tubing drill string. Drilling is an extremely skilled profession and human operators may require years of training.

What is needed then is a control system for precisely maintaining rates of moving a coiled tubing string within a wellbore in various applications.

SUMMARY OF THE INVENTION

In one aspect, embodiments disclosed herein relate to a method of controlling rates of moving a coiled tubing string in a wellbore. The method includes providing an injector head control system for moving a bottom hole assembly at an end of the coiled tubing string in the wellbore, that maintains operating settings of the injector head if the control system determines that the bottom hole assembly is moving in the wellbore within a range of rates, and varies operating settings of the injector head if the control system determines that the bottom hole assembly is moving in the wellbore outside the range of rates, to thereby revert to moving the bottom hole assembly in the wellbore within the range of rates. The control system determines whether the bottom hole assembly is moving within or outside the range of rates based on one or more sources of feedback from both the bottom hole assembly and the injector head.

BRIEF DESCRIPTION OF THE DRAWINGS

The invention is illustrated in the accompanying drawings wherein.

DETAILED DESCRIPTION

Figure 1:
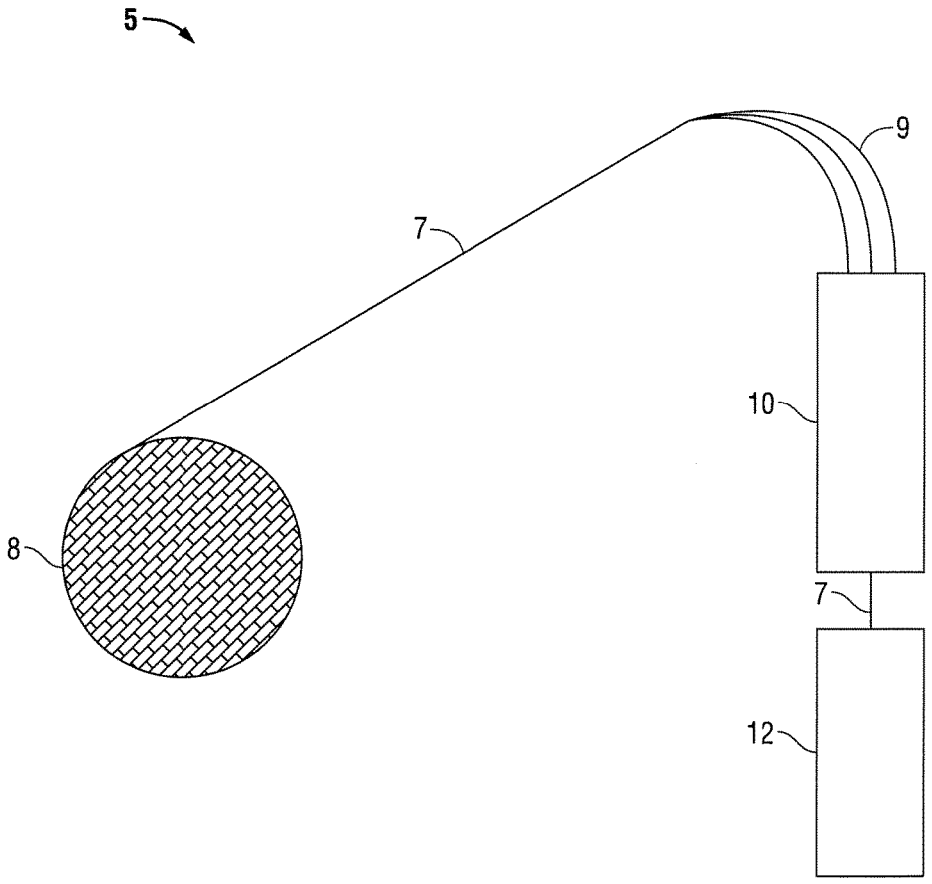
FIG. 1 illustrates a general coiled tubing unit.

Embodiments disclosed herein relate to coiled tubing units. More particularly, embodiments disclosed herein relate to a control system for coiled tubing unit injector heads. More specifically, embodiments disclosed herein relate to a control system and methods for operating a coiled tubing unit injector head and moving a coiled tubing string in a wellbore within a range of rates. The control system, controller, and methods described herein precisely control the rate at which a coiled tubing string is moved within a wellbore, such that any tool at the bottom of the coiled tubing string is moved into or out of a wellbore within a range of rates.

Certain embodiments disclose an automated control system for controlling and/or maintaining the rate of movement of a coiled tubing injector based on feedback from surface instrumentation, sub-surface or downhole instrumentation, a preplanned or manually entered well profile, computerized model or other information source describing the properties of the materials being removed. The control system may make use of any combination of the information sources listed above, as well as others. The control system is configured to operate and control various drive components moving the coiled tubing string within a well bore. Coiled tubing drive components may be controlled by various types of power sources and drive mechanisms.

The coiled tubing string rate control system may be used in any application in which precise control of the rate at which a tool, or bottom hole assembly ("BHA"), is moved into or out of a wellbore is needed. The tool at the bottom of a coiled tubing string is often called the BHA. It can be any downhole tool, such as a jetting nozzle, for jobs involving pumping chemicals or cement through the coiled tubing, or a larger string of logging tools, including logging-while-drilling, or measurement-while-drilling tools. In other applications, a drill bit of any type may be attached at the bottom of the coiled tubing string. For example, the tubing string rate control system may be used in drilling operations employing coiled tubing, in which well obstructions such as plugs, and other man-made and natural formations are drilled. In another example, the tubing string rate control system may be used in well intervention or workover operations. In yet another example, the tubing string rate control system may be used in flushing operations. In yet another example, the tubing string rate control system may be used in acid spotting operations. The BHA may be a downhole drilling assembly, for example, a mud motor.

The control system disclosed herein is configured to move the coiled tubing string at a rate that falls within a range of rates, and in certain instances adjust the rate to a different rate that falls within the same range of rates when upper threshold limits of certain parameters, such as tubing string loads or weight, various differential pressures, or other parameters are reached. Tubing string loads, e.g., weight on the tubing string, are monitored automatically or manually and used as a threshold for when to reduce rates of moving the coiled tubing. For example, if the weight on the tubing string reaches or exceeds a certain level, the control system will reduce the rate of moving the tubing string and thereby reduce the weight on the tubing string to below the threshold level. The tubing string rate control system may further prevent an operator from entering a rate that would result in exceeding a threshold or safe rate of moving the coiled tubing string, and instead default to the closest safe rate within a range or rates of moving the coiled tubing string.

For example, drilling rates may be within a range of rates that is less than one-half (0.5) inch per minute, or less than one (1) inch per minute, or less than two (2) inches per minute, or less than three (3) inches per minute, or less than six (6) inches per minute, or less than one (1) foot per minute, or less than or up to ten (10) feet per minute, or up to twenty (20) feet per minute, or up to thirty (30) feet per minute, or up to forty (40) feet per minute, or up to fifty (50) feet per minute, or up to seventy (70) feet per minute, or up to one hundred (100) feet per minute, or up to one hundred fifty (150) feet per minute, or up to two hundred feet per minute (200), or up to three hundred (300) feet per minute, or greater, and anywhere in between. It is understood that the drilling rates stated above are applicable when converted to other unit measurement systems.

A threshold limit or "not to exceed" rate of drilling may be set at the maximum recommended operating parameters of the BHA as will be understood by those skilled in the art. A safe rate or nominal rate of drilling may be set at any value or amount less than the threshold limit. As one example, the threshold limit or safe rate may be based upon the known, calculated or estimated, properties of a plug or formation being drilled.

In a "preset rate" mode, the operator may manipulate a controller in the control system which controls a hydraulic pump to cause the hydraulic pump to provide hydraulic fluid flow to a hydraulic motor to provide rotational torque to the injector drive mechanism. Two injector drive motors are conventionally provided to power the gripper chains of the injector. The injector then feeds the coiled tubing string into the wellbore.

The tubing string rate control system includes a controller that may be any type of digital computer used for automation of the electromechanical processes described herein. The tubing string rate control system further includes an electro-proportional flow control ("EPFC"), controlled by the controller, which restricts or increases hydraulic flow to injector head motors to set the motor speeds at pre-programmed parameters preset in a data acquisition system ("DAS") or any other computer controlling system including a direct plug-in system at the control cabin.

The tubing string rate control system may be operated in an "automatic" mode whereby the tubing string proceeds within the wellbore at a set rate during a certain interval. An operator is able to select or deselect the automatic mode between intervals. The operator sets a rate for moving the tubing string within the wellbore configured to allow a smooth transition between operating under human control and automated control. For instance, in a drilling application, a drilling rate may be predetermined using historical data from existing jobs, well profiles, plug characteristics and other factors that may influence drilling with a coiled tubing system. This allows the tubing string rate control system to smoothly complete the drilling process the most economical way for both expedience and equipment longevity. It further allows restrictions to be pre-set to prevent human interference with rates of drilling. This system can be disabled during times in which speed is not a problem, e.g., during normal descent. The operator then can either receive a signal from the computer with inputs such as a well profile to elect to proceed using the tubing string rate control system.

In one embodiment, a control system includes a controller that controls a pump and a control valve. The control valve may be an electronic directional control valve ("EDCV") or electro-proportional control flow control, or any other type of electro-proportional control valve. Hydraulic fluid flows to an "Inhole" line to operate the injector motors in a direction for moving coiled tubing into the well. The hydraulic fluid enters a first counterbalance valve after which the flow is divided to each injector motor to power both. Those skilled in the art are familiar with counterbalance valves. Flow from both injector motors is combined and enters another counterbalance valve. A pilot signal from the first counterbalance valve opens the second counterbalance valve to allow the hydraulic fluid to pass through "Outhole" direction of the second counterbalance valve and prevent motor lockup.

A fluid line connecting the Inhole line and the Outhole line may include a valve. The valve may be bi-directional so that fluid may flow in either direction, i.e., from the Inhole line to the Outhole line, or from the Outhole line to the Inhole line. The valve may be opened to bleed fluid from the Inhole line to the Outhole line, or vice versa, which removes available flow to the injector motors and slows injector motor speeds. Injector motor speeds may be controlled in at least two ways, either alone or in combination. First, the pump speed may be controlled and varied to vary injector motor speed. Further, either alone or in combination with varying pump speed, valve may be opened and fluid may be bled from the Inhole line to the Outhole line (or vice versa, as may be applicable, fluid may be bled from the Outhole line to the Inhole line).

During manual operation, that is, when the tubing string rate control system is not activated, no signal is sent from the controller to the pump or the control valve. When the tubing string rate control system is activated, the controller sends a signal to the pump and the control valve, which allows for metering of flow that opens the first and second counterbalance valves and sends flow to the direction needed. Opposite force may be needed due to the weight of the tubing string, or conversely, the advancement due to the lack of weight on the tubing string.

Figure 2:
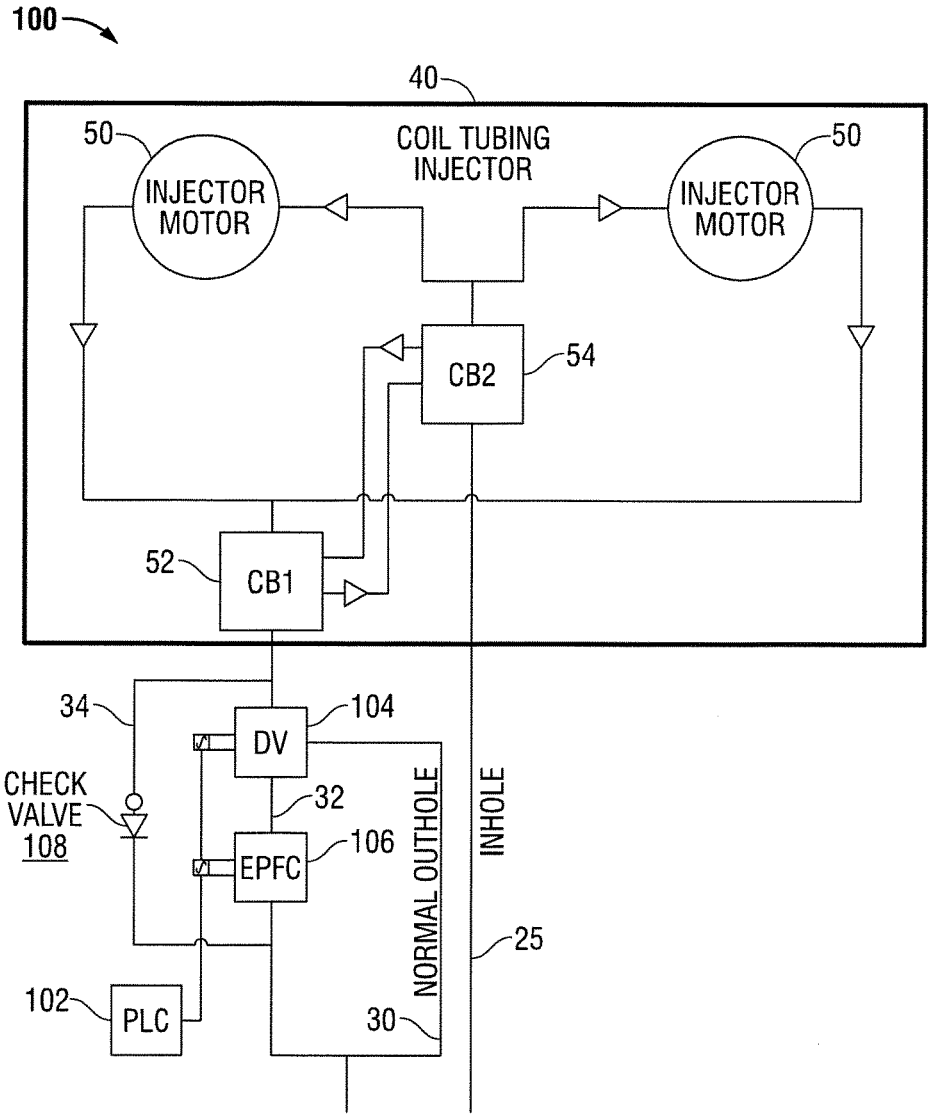
FIG. 2 illustrates an embodiment of a control system for moving a coiled tubing string within a wellbore.

FIG. 2 illustrates a schematic of an embodiment of a coiled tubing rate of bit tubing string rate control system 100. The tubing string rate control system 100 ties into and communicates with a standard coiled tubing injector head 40 having injector motors 50 and counterbalance valves 52, 54. The tubing string rate control system 100 can be operated when mounted directly to or apart from the injector head 40. "Inhole" 25 refers to hydraulic flow which operates the injector motors 50 in a manner that moves the coiled tubing string into a well. "Outhole" 30 refers to hydraulic flow which operates the injector motors 50 in a manner that moves the coiled tubing string towards the surface or out of the well.

The tubing string rate control system 100 includes a controller 102 in communication with an electro-proportional flow control ("EPFC") 106 configured to restrict or increase hydraulic flow to the injector head motors 50, and thereby regulated and set motor speeds. The tubing string rate control system 100 further includes a diverter valve ("DV") 104 in communication with and controlled by the controller 102. The diverter valve 104 is configured to route fluid from the injector motors 50 either through a normal outhole line 30, or through the EPFC 106 when the tubing string rate control system is actuated.

Hydraulic fluid flows to the Inhole line 25 to operate the injector motors in a direction for moving coiled tubing into the well. The hydraulic fluid enters a second counterbalance valve ("CB2") 54 after which the flow is divided to each injector motor 50 to power both. Flow from both injector motors 50 is combined and enters a first counterbalance valve ("CB1") 52. A pilot signal from the second counterbalance valve ("CB2") 54 opens the first counterbalance valve ("CB1") 52 to allow the hydraulic fluid to pass through the Outhole direction of the first counterbalance valve ("CB1") 52 and prevent motor lockup.

Flow from the injector motors 50 proceeds to the diverter valve ("DV") 104. A normal Outhole flow is achieved by actuating the diverter valve 104 in a manner that routes fluid flowing from the injector motors 50 through the normal Outhole line 30. The tubing string rate control system proceeds automatically at a rate of drilling within a range of rates by actuating the diverter valve 104 in a manner that routes fluid flowing from the injector head 40 through a line 32 to the EPFC 106, which allows the controller 102 to regulate flow based on pre-programmed parameters.

To remove the coiled tubing from the well, fluid is returned to the injector motors 50 through Outhole actuation, whereby the controller 102 actuates the most expedient and less restrictive flow to return to the first counterbalance valve ("CB1") 52. A check valve 108 allows flow to travel through a fluid line 34 and bypass the diverter valve 104. The first counterbalance valve ("CB1") 52 then returns flow back to the injector motors 50, which are then operated in a manner that retrieves the coiled tubing from the well. The flow then is combined back to the second counterbalance valve ("CB2") 54, which then flows back through the Inhole line 25.

Figure 3:
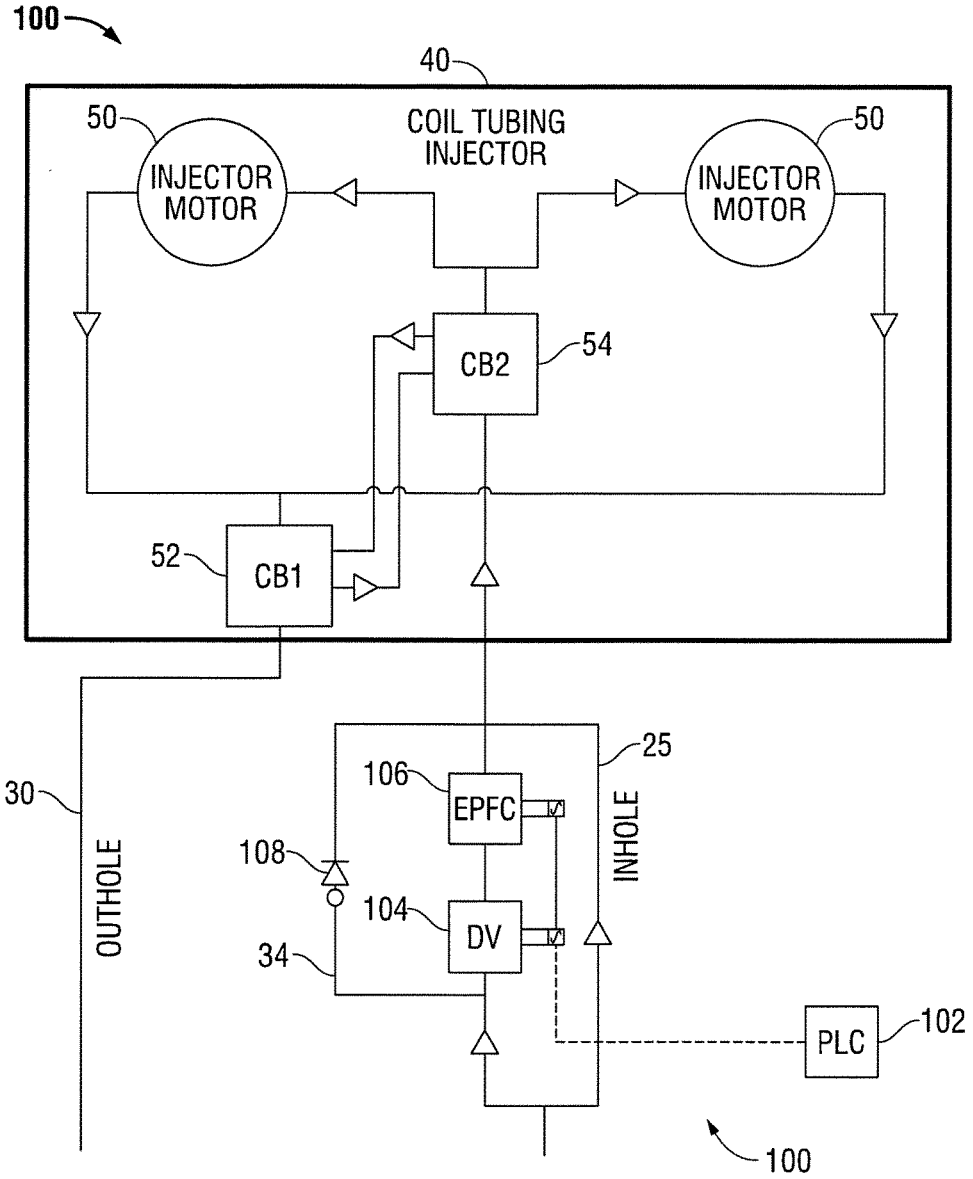
FIG. 3 illustrates an alternate embodiment of a control system for moving a coiled tubing string within a wellbore.

FIG. 3 illustrates a schematic of an alternate embodiment of a coiled tubing rate of bit tubing string rate control system 100. The same components described in reference to FIG. 2 are included and operated to apply the same controls of the tubing string rate control system 100 on the Inhole side 25 as shown in FIG. 3.

Figure 4:
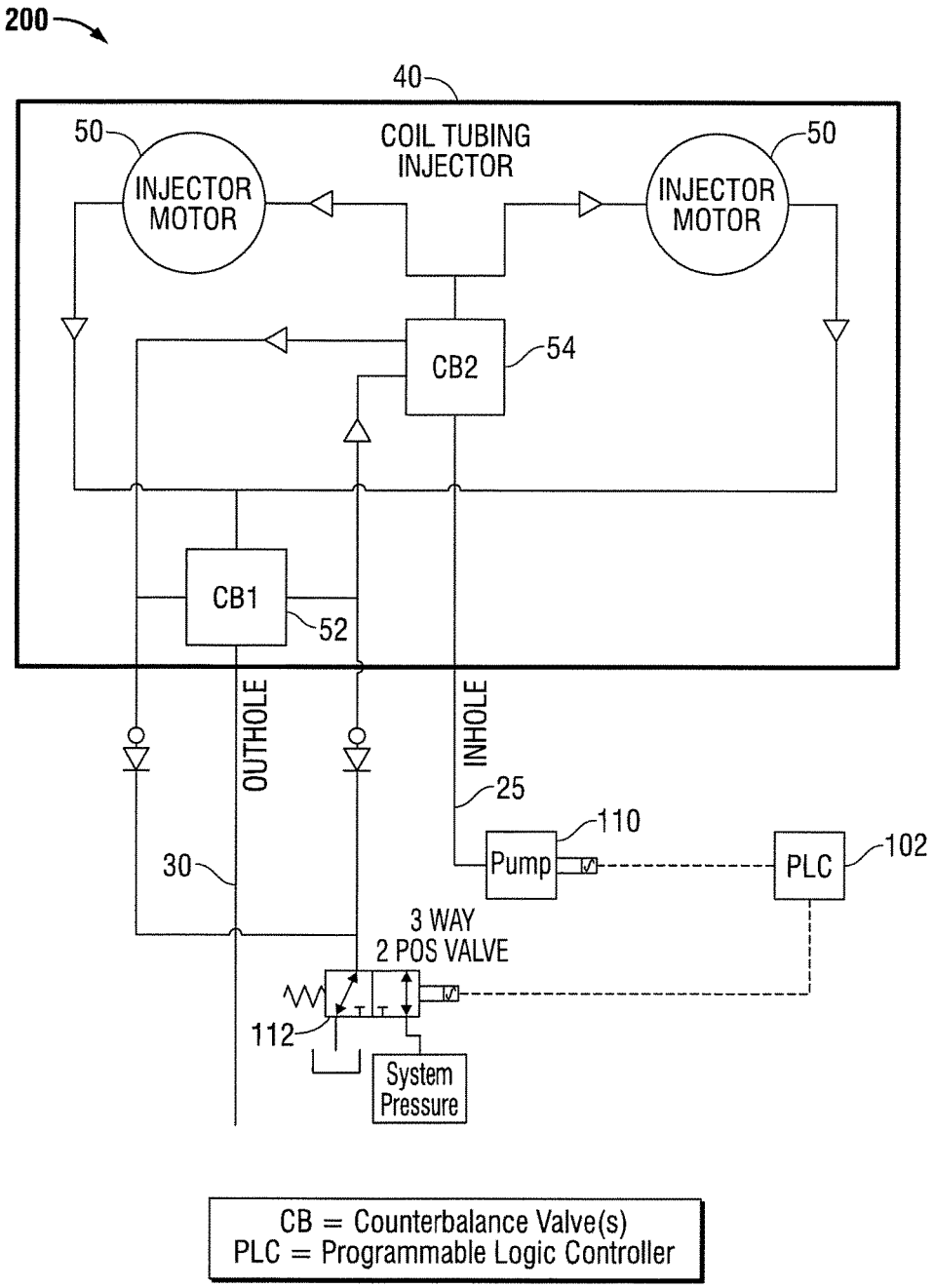
FIG. 4 illustrates an alternate embodiment of a control system for moving a coiled tubing string within a wellbore.
Figure 5:
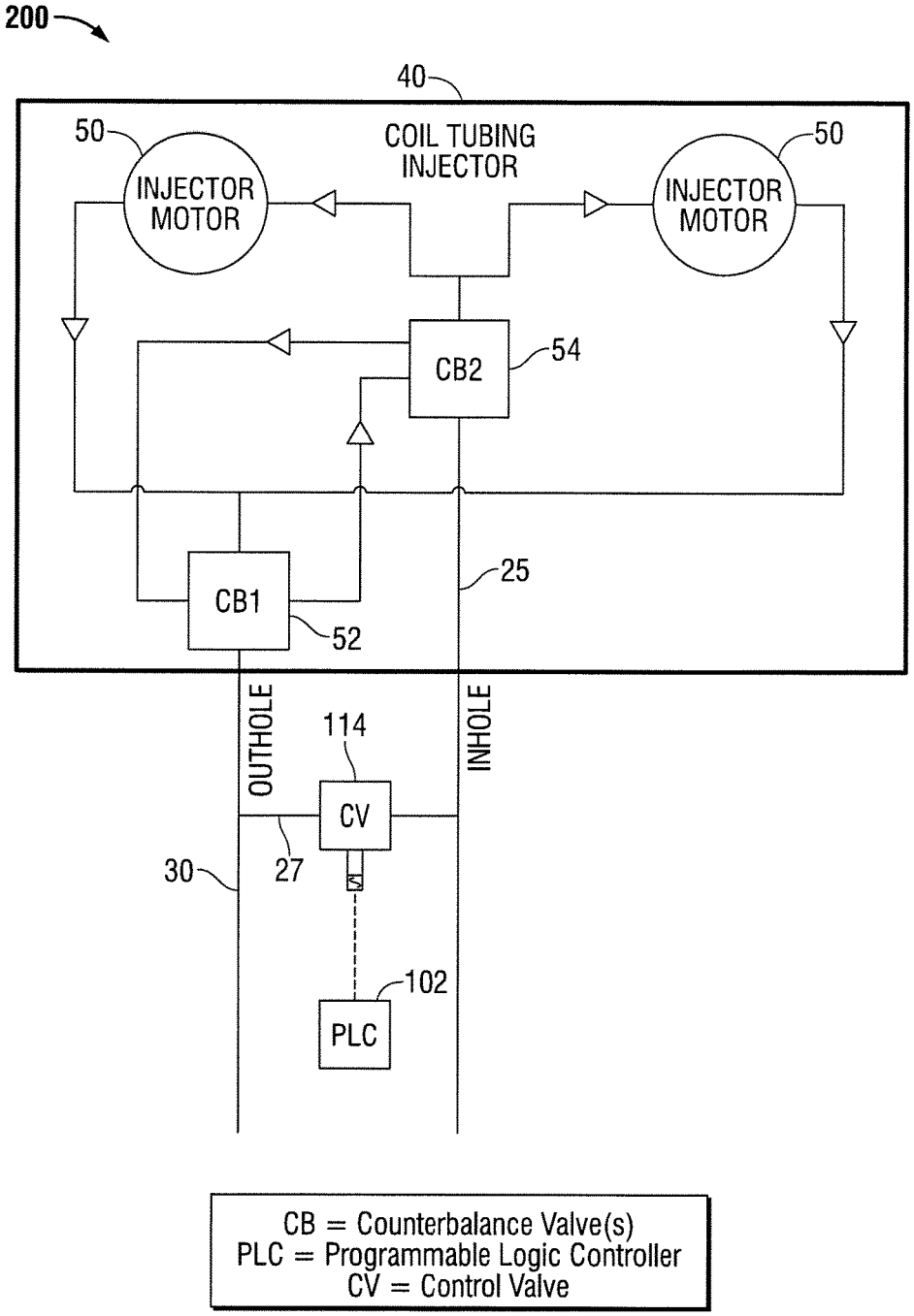
FIG. 5 illustrates an alternate embodiment of a control system for moving a coiled tubing string within a wellbore.

FIGS. 4 and 5 illustrate schematics of another embodiment of a coiled tubing string rate control system 200. The tubing string rate control system 200 includes a controller 102 that controls a pump 110 and an electronic directional control valve ("EDCV") 112. Hydraulic fluid flows to the Inhole line 25 to operate the injector motors 50 in a direction for moving coiled tubing into the well. The hydraulic fluid enters a second counterbalance valve ("CB2") 54 after which the flow is divided to each injector motor 50 to power both. Flow from both injector motors 50 is combined and enters a first counterbalance valve ("CB1") 52. A pilot signal from the second counterbalance valve ("CB2") 54 opens the first counterbalance valve ("CB1") 52 to allow the hydraulic fluid to pass through the Outhole direction of the first counterbalance valve ("CB1") 52 and prevent motor lockup.

FIG. 5 illustrates a fluid line 27 connecting the Inhole line 25 and the Outhole line 30. The fluid line 27 includes a valve 114. The valve 114 may be bi-directional so that fluid may flow in either direction, i.e., from the Inhole line 25 to the Outhole line 30, or from the Outhole line 30 to the Inhole line 25. The valve 114 may be opened to bleed fluid through the fluid line 27, sometimes referred to as a crossover or bypass fluid line, from the Inhole line 25 to the Outhole line 30, or vice versa, which removes available flow to the injector motors 50 and slows injector motor speeds.

Injector motor 50 speeds may be controlled in at least two ways, either alone or in combination. First, a pump (not shown) speed may be controlled and varied to vary injector motor 50 speed. Further, either alone or in combination with varying pump speed, valve 114 may be opened and fluid may be bled through the fluid line 27 from the Inhole line 25 to the Outhole line 30 (or vice versa, as may be applicable, fluid may be bled from the Outhole line 30 to the Inhole line 25).

During manual operation, that is, when the tubing string rate control system 200 is not activated, no signal is sent from the controller 102 to the pump 110 or the EDCV 112. When the tubing string rate control system 200 is activated, the controller 102 sends a signal to the pump and the EDCV 112, which allows for metering of flow that opens the first and second counterbalance valves 52, 54, and sends flow to the direction needed. Opposite force may be needed due to the weight of the tubing string, or conversely, the advancement due to the lack of weight on the tubing string.

Certain embodiments disclosed herein relate to a method of controlling rates of moving a coiled tubing string in a wellbore that includes providing an injector head control system for moving a bottom hole assembly at an end of the coiled tubing string in the wellbore, that (i) maintains operating settings of the injector head if the control system determines that the bottom hole assembly is moving in the wellbore within a range of rates, and (ii) varies operating settings of the injector head if the control system determines that the bottom hole assembly is moving in the wellbore outside the range of rates, to thereby revert to moving the bottom hole assembly in the wellbore within the range of rates. The control system determines whether the bottom hole assembly is moving within or outside the range of rates based on one or more sources of feedback from both the bottom hole assembly and the injector head.

In certain embodiments, methods of controlling rates may include entering an initial rate, and varying from the initial rate if not within the range of rates.

In certain embodiments, methods of controlling rates may include entering an initial rate, and varying from the initial rate if moving the bottom hole assembly in the wellbore at the initial rate causes a predetermined threshold parameter to be reached. The predetermined threshold parameter may be, for instance, a predetermined differential pressure of the bottom hole assembly. Coiled tubing uses a downhole mud motor—powered by drilling fluid pumped from the surface—to turn a drill bit. When the drill bit is bottomed and the mud motor is working effectively, there is a notable increase in the pressure in the fluid system. This is caused by a restriction within the motor and is termed the "differential pressure." However, if the force of the drill bit against the formation becomes too great and causes the mud motor to slow down or even stop entirely, i.e., stall, the differential pressure will increase, potentially rising to what is known as "stall pressure." This increases the chances of becoming stuck in the wellbore. Thus, embodiments disclosed herein provide a control system that varies from an initial rate if moving the bottom hole assembly, e.g., a mud motor, in the wellbore at the initial rate causes a predetermined differential pressure to be reached. The predetermined differential pressure is a pressure less than the stall pressure for a particular mud motor.

One or more sources of feedback may include surface instrumentation, downhole instrumentation, and preplanned or manually entered stage data, and information describing the properties of materials in the wellbore being removed.

In drilling applications, the control systems described herein provide a method and system for continuously and automatically controlling the drilling rate such that the borehole, or well obstructions are drilled substantially along a preplanned well profile that is pre-loaded into the system. For example, the well may be vertical, horizontal, or complex. In this way, an operator may load a preplanned well profile into the system with details of well segments and distances from the surface. The tubing string rate control system may be initiated and automatically programmed to perform downhole operations, as needed at different wellbore locations and in various well segments. In this way, an operator may further load a preplanned well profile into the system with details of well segments and plug distances from the surface, and the control system may be initiated and automatically programmed to drill the plugs at a preset rate at the various well segments without operator intervention. Further, in the event that the preset rate reaches or exceeds an upper threshold limit, e.g., a drilling load not to be exceeded, the control system may automatically reduce the drilling rate to a lower safe rate, and continue drilling the remaining sections.

The control system described herein may be incorporated into a system that includes a drill string, a drill bit, an appropriate motor for rotating the drill bit, a data processing system for storing a planned well profile, sensors for obtaining information for providing a planned well profile, a data processing system for comparing the drilled profile with the planned well profile and for generating a correction signal representing the difference between the drilled profile and the planned well profile, and a control system responsive to the correction signal to cause the drill string to follow a corrected path to cause the drilled profile to coincide with the planned profile.

The control system may further be incorporated into a system that includes a data acquisition system with parameters that includes previous data from well profiles, previous data of drilling through different types and material plugs, e.g., different compositions, sizes, etc., operational input for speeds on drilling, e.g., trouble speeds such as too fast, or too slow, analysis of well obstruction breakup that pose a danger to causing the coiled tubing string to stick, and historical load cell curves for encountering obstacles in the wellbore.

The claimed subject matter is not to be limited in scope by the specific embodiments described herein. Indeed, various modifications of the invention in addition to those described herein will become apparent to those skilled in the art from the foregoing description. Such modifications are intended to fall within the scope of any claims.

What is claimed is:

1. A coiled tubing control system for use in operating an injector head moving a bottom hole assembly at an end of a coiled tubing string in a wellbore, the control system comprising:

a controller that determines whether the bottom hole assembly is moving within or outside a range of rates based on one or more sources of feedback from both the bottom hole assembly and the injector head, wherein the controller is configured to maintain an initial rate that has been entered, unless the controller determines that moving the bottom hole assembly in wellbore at initial rate causes a predetermined threshold parameter to be reached, whereupon the controller defaults to moving the bottom hole assembly at a safe rate within the range of rates calculated by the controller based upon the properties of a plug or formation being drilled.

2. The control system of claim 1, wherein the predetermined threshold parameter is a predetermined differential pressure of the bottom hole assembly.

3. The control system of claim 1, wherein the one or more sources of feedback comprise surface instrumentation.

4. The control system of claim 1, wherein the one or more sources of feedback comprise downhole instrumentation.

5. The control system of claim 1, wherein the one or more sources of feedback comprise pre-planned or manually entered stage data.

6. The control system of claim 1, wherein the one or more sources of feedback comprise information describing the properties of a plug or formation being drilled.

7. The control system of claim 1, wherein the bottom hole assembly comprises a drilling assembly.

8. The control system of claim 1, wherein the bottom hole assembly comprises a mud motor.

* * * * *